United States Patent [19]

Cellini

[11] Patent Number: 4,754,504

[45] Date of Patent: Jul. 5, 1988

[54] SHOWER ENLARGER

[76] Inventor: William F. Cellini, 1231 W. Vine, Springfield, Ill. 62704

[21] Appl. No.: 107,166

[22] Filed: Oct. 13, 1987

Related U.S. Application Data

[63] Continuation-in-part of Ser. No. 836,405, Mar. 5, 1986, abandoned, and a continuation-in-part of Ser. No. 836,406, Mar. 5, 1986, abandoned.

[51] Int. Cl.[4] ..... A47K 3/22

[52] U.S. Cl. ..... 4/610; 4/605; 4/607; 4/608; 4/558; 160/330; 16/94 D; 211/105.2

[58] Field of Search ..... 4/608, 610, 605, 596, 4/597, 609, 612, 613, 607, 614; D6/549; 160/349 R, 330, 345; 16/87.6 R, 94 D

[56] References Cited

U.S. PATENT DOCUMENTS

| | | | |
|---|---|---|---|
| D. 236,864 | 9/1975 | Tegner | D6/549 |
| 1,487,017 | 3/1924 | Lilja | 211/105.2 X |
| 2,195,979 | 4/1940 | Ziolkowski | 211/105.2 X |
| 2,219,075 | 10/1940 | Le Veau | 4/610 |
| 2,573,985 | 11/1951 | Porter | 4/610 |
| 2,774,974 | 12/1956 | Zaloga | 4/610 |
| 2,778,030 | 1/1957 | Goche | 4/608 |
| 2,796,227 | 6/1957 | Cookley | 4/608 |
| 3,418,665 | 12/1968 | Long | 4/610 |
| 3,872,520 | 3/1975 | Tyconik | 4/610 |
| 4,229,842 | 10/1980 | Gilmore | 4/558 X |

*Primary Examiner*—Henry K. Artis

*Attorney, Agent, or Firm*—Charles F. Meroni, Jr.

[57] ABSTRACT

A shower stall structure for bathing having a shower area defined on three sides by upright walls and having an open side area with a shower curtain mounted therein to provide a covered point of entry for a person. A shower enlarger mounted in the shower area. The enlarger comprises a one-piece curtain rod having an offset medial section engageable with an upper area of the shower curtain for providing a greater stall space for upper body movement while showering. The offset medial section includes a pair of angular curtain rod sections which extend in diverging relation away from opposite ends of the offset medial section. The angular curtain rod sections have end sections at outer ends thereof. The outer ends of the end sections extend in opposite directions away from one another. Fastening structure is provided for securing the outer ends of the end sections in assembly with opposed upright walls of the shower area. The end sections are positioned in relation to the mid-section so as to extend generally in the same direction.

11 Claims, 6 Drawing Sheets

SHOWER ENLARGER

The present application is a continuation-in-part of my earlier filed co-pending U.S. application entitled: "Shower Enlarger", U.S. Ser. Nos. 836,405 and 836,406 filed on Mar. 5, 1986, both now abandoned.

BACKGROUND OF THE INVENTION

1. Field of the Invention

The present invention is concerned with a new and improved shower enlarger for a shower area whereby the shower area can be enlarged to provide a greater stall space for upper body movement of a person using the shower.

The present invention more particularly concerns a new and improved shower enlarger of a simplified construction and which may be uniquely shaped and manufactured in one piece in a more simplified and economic way than previously known.

The shower enlarger in one form of my invention preferably comprises a one-piece curtain rod having an offset medial section for outwardly displacing an upper area of a shower curtain to allow a greater space in a shower stall for upper body movement while showering. The enlarger further has an offset medial section which includes a pair of angular curtain rod sections that extend in diverging relation away from opposite ends of the offset medial section. The angular curtain rod sections have end sections at outer ends thereof. The outer ends of the end sections extend in opposite directions away from one another. The end sections are positioned in parallel relation to the mid-section. The end sections are adapted to be engaged with opposed walls of a shower stall.

The shower enlarger in another form of my invention differs from the above described embodiment in that the offset medial section is of an arcuate construction and the angular curtain rod sections are omitted.

2. Description of the Prior Art

Heretofore, shower enlargers have been proposed for use in shower stalls for engagement with a shower curtain to offset the shower curtain to provide a greater stall space for upper body movement while showering. Examples of such previously known shower enlargers are disclosed in the following U.S. patents:

| U.S. PAT. NO. | PATENTEE |
|---|---|
| 2,219,075 | E. LeVeau |
| 2,573,985 | G. G. Porter |
| 2,774,974 | E. A. Zaloga |
| 3,418,665 | J. C. Long |
| 4,229,842 | Louis Gilmore |

U.S. Pat. No. 2,219,075 discloses a curtain support for installation over a tub. This curtain support involves a generally U-shaped curtain rod 5 and opposite ends of the curtain are adapted to be anchored into the wall positioned at one side of the tub. The anchor plates 11—11 (FIG. 1) are attached to the upright wall in overlying relation to the tub. In addition, the rod 5 is supported by an elongated hanger member 17 (FIGS. 1 and 2) for supporting a medial portion of the bracket. This patent fails to teach how to construct a curtain rod which would enable the shower curtain to be deflected by using an offset medial curtain rod section to provide more space for upper body movement by a person using the shower.

U.S. Pat. No. 2,573,985 shows a curtain rod support 13 that is movable into three different positions to move the curtain rod relative to the tub either inside or outside of the tub as may be desired. The curtain rod support includes a lock pin 21 that is engageable in lock plate hole 22 to move the curtain 11 to different adjusted positions relative to the tub as shown by the dotted lines in FIG. 1. This patent does not show a one-piece curtain rod having an offset medial curtain rod section adapted to serve as a shower enlarger having the unique shape, features and advantages of my invention.

U.S. Pat. No. 2,774,974 shows a curtain rod 2 having an attachment secured to it which is generally indicated at 10. The curtain rod is adapted to suspend a shower curtain 8 from it by means of the clips indicated at 4. In order to enable the curtain rod to be moved laterally away from the tub to enlarge the size of the shower stall, the attachment 10 is secured by thumb screw 16 to the curtain rod. The attachment 10 is shown in FIG. 1 and includes a long arm having a curtain holder piece 18 that extends downwardly therefrom. It will further be seen in FIG. 1 that the clips holding the curtain to the curtain rod 2 can be moved from a conventional position to one whereby the clips are supported on the curtain rod attachment in such a way that the curtain rod extends at right angles away from the curtain rod and then downwardly in supported position by the curtain holder piece 18.

U.S. Pat. No. 3,418,665 discloses a U-shaped supplementary curtain rod 6 which is mounted on the conventional curtain rod 5 by a suitable set of clamps as indicated at 5 in FIGS. 1 and 2. The supplementary curtain rod 6 has curtain hanger clips 9 mounted thereon and the curtain is suspended from the hooks in such a way that the size of the shower stall can be enlarged as is evident from a consideration of FIGS. 1 and 2.

U.S. Pat. No. 4,229,842 is entitled "Shower Curtain Convertible Support Adapter". The patentee here refers to his device as a shower curtain adapter for expanding the showering space withn a shower enclosure, etc. Referring to FIG. 2 of the patent, it will be seen that a conventional curtain rod is indicated at 1 and a bowed curtain rod 3 is positioned between closed walls of the shower stall and which curtain rod 3 is bowed at its medial section in a direction away from the curtain rod 1 and away from the tub 8 so as to create a bowed effect whereby a shower curtain suspended by clips from the shower rod 1 can be caused to be moved away from the tub so as to enlarge the space for body movement above the waist. This subject is discussed in column 2, lines 32–40. Here again, the device shown in this prior art patent does not show a one-piece shower enlarger having the unique shape which enables cost savings and a more simplified construction facilitating manufacture.

SUMMARY OF THE INVENTION

In a shower structure for bathing having a shower area defined on three sides by upright walls and having an open side above a shower rim with a shower curtain mounted thereby to provide a covered point of entry for a person, the improvement of a shower enlarger mounted in the shower area, the enlarger comprising a one-piece curtain rod having an offset medial section engageable with an upper area of the shower curtain positioned outwardly of the shower rim beyond the shower area for providing a greater stall space for upper body movement while showering, the offset medial section includes a pair of angular curtain rod sections which extend in diverging relation away from opposite ends of the offset medial section, the angular curtain rod sections having end sections at outer ends thereof overlying the shower rim, the outer ends of the end sections extending in opposite directions away from one another, means for securing the outer ends of the end sections in vertical overlying alignment with the shower rim and in assembly with opposed upright walls of the shower area, and the end sections being positioned in parallel relation to the mid-section.

In a shower structure for bathing having a shower area defined on three sides by upright walls and having an open side above a shower rim with a shower curtain mounted thereby to provide a covered point of entry for a person, the improvement of a shower enlarger mounted in the shower area, the enlarger comprising a one-piece curtain rod having an offset medial section engageable with an upper area of the shower curtain positioned outwardly of the shower rim beyond the shower area for providing a greater stall space for upper body movement while showering, the offset medial section includes a pair of angular curtain rod sections which extend in diverging relation away from opposite ends of the offset medial section, the angular curtain rod sections having end sections at outer ends thereof overlying the shower rim, the outer ends of the end sections extending in opposite directions away from one another, means for securing the outer ends of the end sections in vertical overlying alignment with the shower rim and in assembly with opposed upright walls of the shower area, and the end sections being positioned with relation to the mid-section so as to extend generally in the same direction.

In a shower structure for bathing having a shower area defined on three sides by upright walls and having an open side with a shower curtain mounted therein to provide a covered point of entry for a person, the improvement of a shower enlarger mounted in the shower area, the enlarger comprising a one-piece curtain rod extending generally in lineal direction but having an arcuately offset medial section engageable with an upper area of the shower curtain for providing a greater stall space for upper body movement while showering, the one-piece curtain rod extending in an essentially lineal direction with the exception of the arcuately offset medial section which bulges to one side of the lineal direction of the rod for expanding the shower area, the arcuately offset medial section having a radius of curvature, a shower curtain mounted and supported on the one-piece curtain rod, the arcuately offset medial section of the curtain rod co-acting with the shower curtain to arcuately bulge the shower curtain thereby providing a greater stall space for upper body movement, arcuately offset medial section having end sections at outer ends thereof, the outer ends of the end sections extending in opposite directions away from one another, means for securing the outer ends of the end sections in assembly with opposed upright walls of the shower area, and the end sections being positioned in parallel relation to the midsection.

DESCRIPTION OF THE PREFERRED EMBODIMENTS

Figure 1:
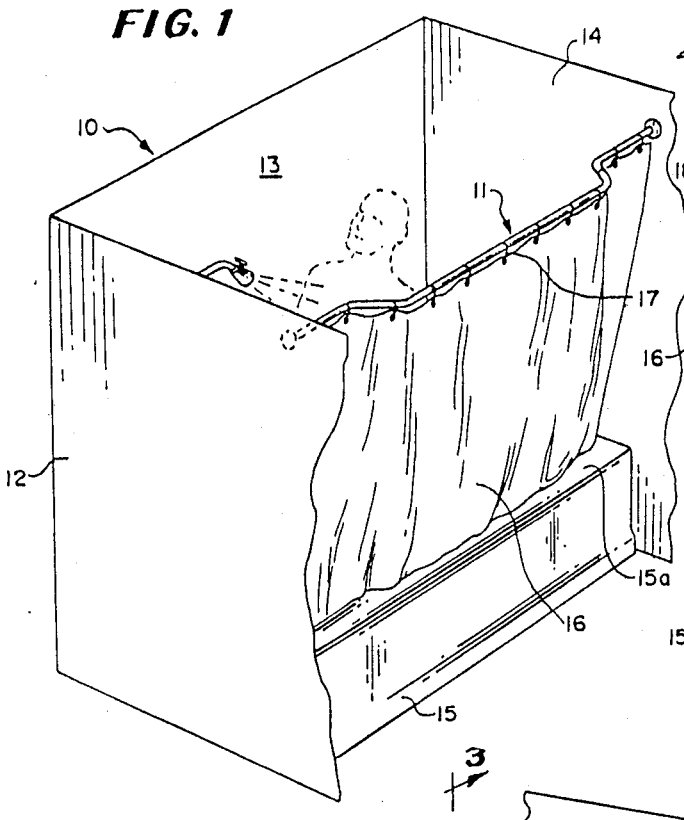
FIG. 1 is an enlarged fragmentary perspective view shown in full and dotted lines depicting a shower area over a bathtub having my new shower enlarger mounted therein and embodying important principles of my invention.
Figure 3:
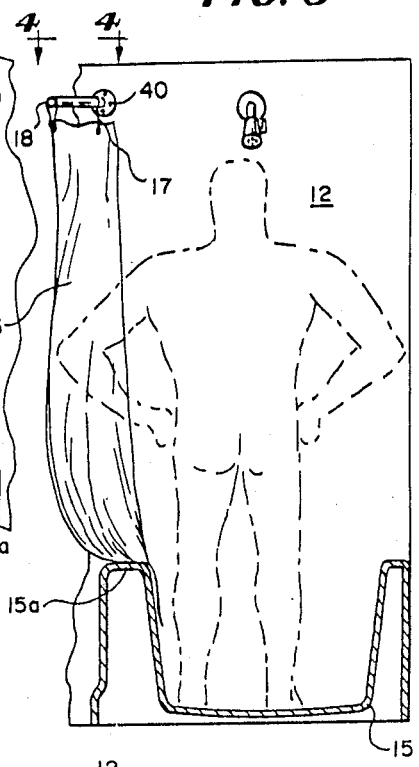
FIG. 3 is an enlarged fragmentary partially sectioned view as viewed on the lines III—III looking in the direction indicated by the arrows as seen in FIG. 2.
Figure 2:
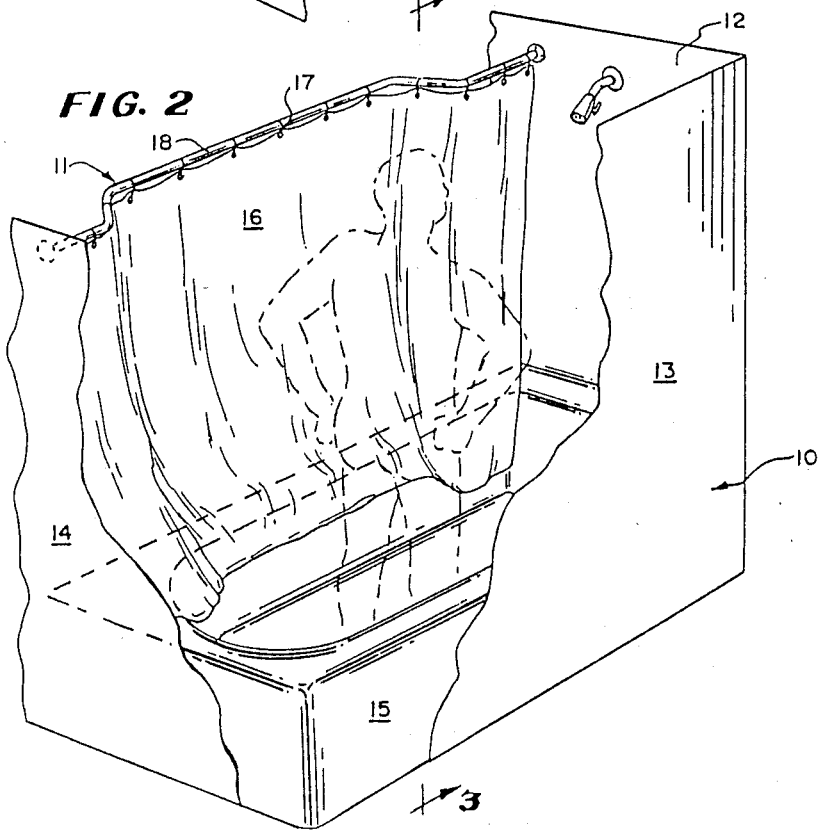
FIG. 2 is an enlarged fragmentary perspective view of the shower area shown in FIG. 1 only illustrating the shower area from an opposite corner position 180° of the position of the shower area shown in FIG. 1.

The reference numeral 10 indicates generally a shower structure for a bathtub, as seen in FIGS. 1–3, inclusive. Within the shower structure and embodying important features of my invention is a shower enlarger 11 which not only is seen in FIGS. 1–3 but is shown by itself in FIG. 4. The enlarger 11 is also suitable for use in a shower stall without a tub in it. The shower enlarger comprises preferably a one-piece tubular curtain rods which can be made from any suitable metal such as a suitable type of stainless steel or brass and could also be manufactured from a suitable synthetic plastic.

The shower structure itself includes three sides or upright walls 12, 13, and 14 which are positioned in U-shaped relation about the perimeter of a bathtub 15. A shower curtain 16 is provided and this curtain is adapted to close an open side of the shower stall when mounted therein. Suitable clips or fasteners 17 are provided for securing the curtain 16 on the shower enlarger or one-piece curtain rod 11.

The shower enlarger or one-piece curtain rod 11 has an offset medial section 18 for outwardly displacing an upper area of a shower curtain to allow a greater space in a shower area for upper body movement while showering in the bathtub. It will be seen in FIGS. 2 and 3 how the medial section 18 functions to cause the shower curtain to move laterally where it is disposed above the tub rim 15*a* to balloon the shower curtain in a direction away from the wall 13 to provide greater space for a person to have unrestricted body movement while in the shower stall as best seen in FIG. 3.

Figure 5:
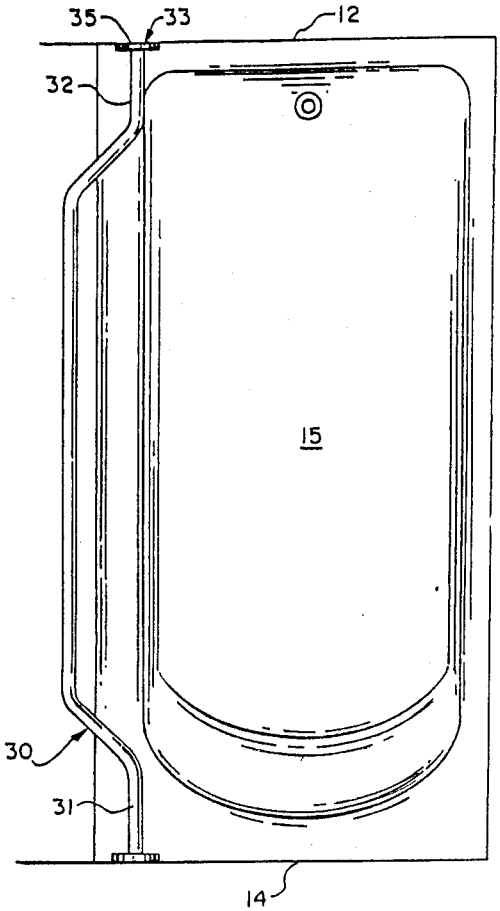
FIG. 5 is an enlarged plan view of the shower enlarger mounted in an overhead position relative to a bathtub.
Figure 6:
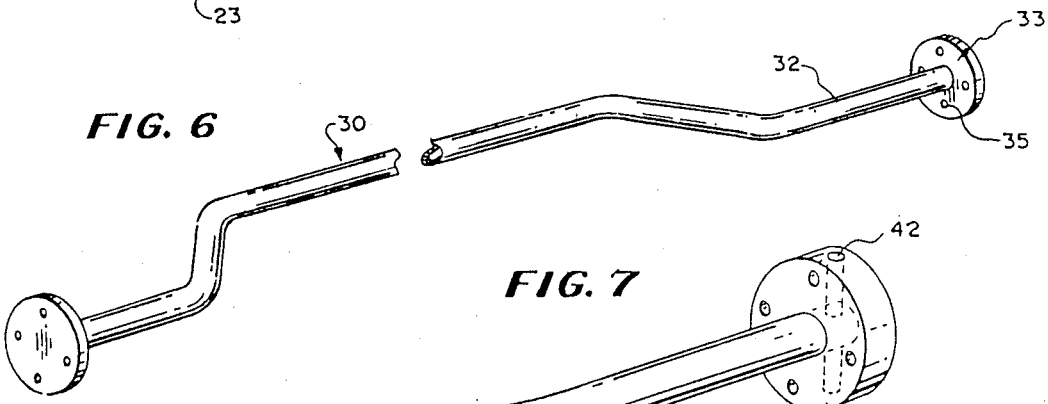
FIG. 6 is an enlarged fragmentary perspective view of the shower enlarger shown in FIG. 5.

The offset medial section 18 includes a pair of angular curtain rod sections 19 and 20 which extend in diverging relation away from opposite ends of the offset medial section 18. The angular curtain rod sections 19 and 20 have end rod sections 21 and 22 at outer ends thereof. The end sections 21 and 22 extend in opposite directions away from one another and are positioned in parallel relation to the mid-section 18. Attachment plates or flanges 23 and 24 are preferably welded to the ends of the end sections 21 and 22. These plates 23 and 24 are adapted to be engaged with opposing walls 12 and 14 of the shower structure 10 to support the shower curtain 16 in a new and improved way thus providing important advantages to the user of the shower enlarger or one-piece curtain rod. As a preferred standard construction, the one-piece curtain rod 11 can be manufactured having a standard bathtub length of 4 feet 10¾ inches; however, deviation from the standard tub can dictate a shorter or longer length. The end sections 21 and 22 can most desirably have a length of about 8 inches. The offset of the offset medial portion 18 can most desirably be of the order of 6 inches measured from the mid-point of the medial rod portion 18 to the mid-portion of the end sections 21 and 22; however, for larger than normal-sized people this offset medial portion can be larger. When the shower enlarger or curtain rod 11 is mounted in the shower structure 10, the rod is most desirably mounted even with the back face of the front of the tub so that the end sections 21 and 22 or 31 and 32 (as hereafter will be described in further detail) will line up with the back face of the front of the tub 15 as seen in FIG. 5. It will be further appreciated that in a normal shower rod installation of the type where the shower is just a continuous straight rod, the shower rod would be mounted in a position where it would be disposed vertically above and in line with the front face of the tub. By providing a new and improved shower enlarger or offset curtain rod as herein disclosed at 11, the shower curtain can be moved laterally away from the rear wall 13 to provide greater space in the shower stall for personal comfort.

It will be appreciated that when the shower enlarger 11 or 30 is to be mounted in the shower structure 10 that the end sections or plates 23, 24 and 33 are all adapted to be secured by suitable fasteners such as metal screws 40 (FIG. 3) to properly position and to permanently install the curtain rod in its desired aligned position above the back face of the front of the tub.

Figure 7:
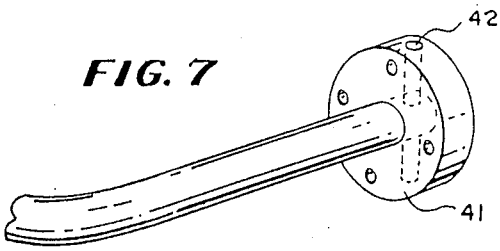
FIG. 7 is an enlarged fragmentary perspective view of a modified shower enlarger rod.

In FIG. 7, I have illustrated a modified construction where a modified ring-shaped end plate or ring flange 41 is provided with a set screw 42 enabling the position of the rod 30 to be varied with respect to the end plate 41 for situations where it may be necessary to adjust the width of the rod to fit the space where the rod is to be mounted. The end of the rod is slip fitted into the ring flange. The rod is marked where the set screw hole aligns with the rod when the rod and ring flange are in proper position and then the rod is drilled to provide a set screw opening. The set screw can then be screwed into the ring flange, telescoped through the rod and extended through the opposite side of the rod into the ring flange to anchor these components securely together in an adjusted position.

Figure 8:
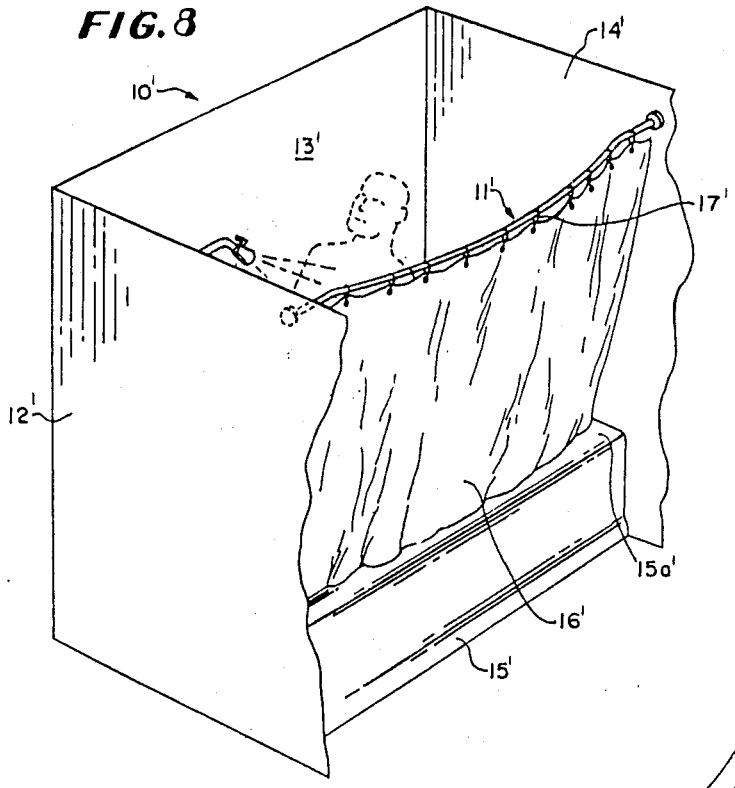
FIG. 8 is an enlarged fragmentary perspective view shown in full and dotted lines depicting a shower area over a bathtub having a modified shower enlarger mounted therein and embodying important principles of my invention.
Figure 9:
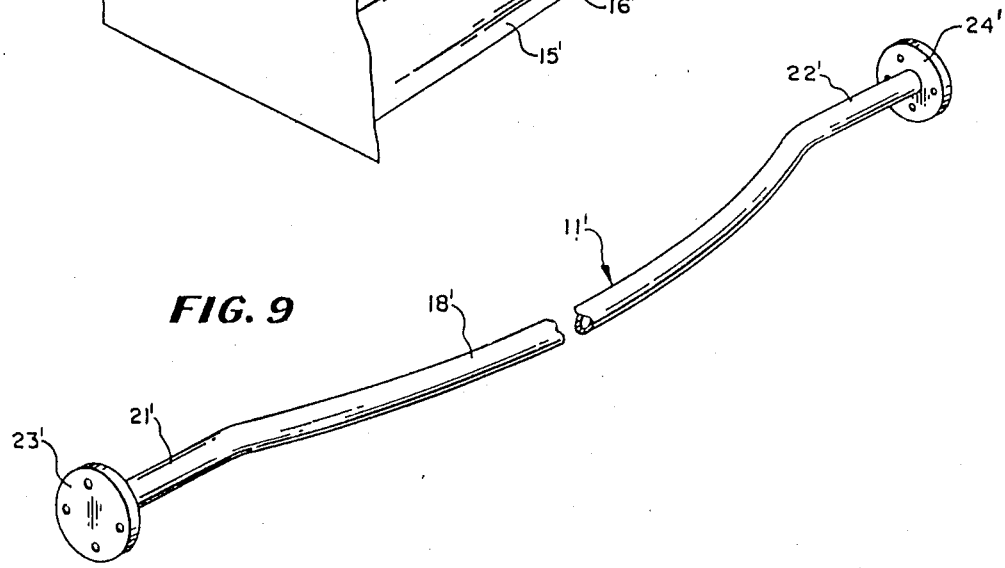
FIG. 9 is an enlarged fragmentary perspective view of the shower enlarger shown in FIG. 8 shown in full and dotted lines.
Figure 10:
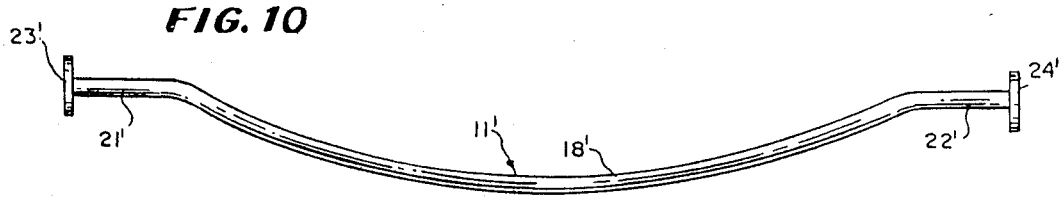
FIG. 10 is a top plan view of the shower enlarger in FIG. 8.

The reference numeral 10' indicates generally a modified shower structure for a bathtub, as seen in FIG. 8. Within the shower structure and embodying important features of my invention is a modified type of shower enlarger 11' also embodying important features of my invention. The enlarger 11' is shown in FIGS. 8–10 inclusive. The shower enlarger comprises preferably a one-piece tubular curtain rod which can be made from any suitable metal such as a suitable type of stainless steel or brass and could also be manufactured from a suitable synthetic plastic.

The shower structure itself includes three sides or upright walls 12', 13' and 14' which are positioned in U-shaped relation about the perimeter of a bathtub 15'. A shower curtain 16' is provided and this curtain is adapted to close an open side of the shower stall when mounted therein. Suitable clips or fasteners 17' are provided for securing the curtain 16' on the shower enlarger or one-piece curtain rod 11' .

The shower enlarger or one-piece curtain rod 11' has an arcuately-shaped offset medial section 18' for outwardly displacing an upper area of a shower curtain to allow a greater space in a shower area for upper body movement while showering in the bathtub. FIG. 8 illustrates how the medial section 18' functions to cause the shower curtain to move laterally where it is disposed about the tub rim 15*a'* to balloon the shower curtain in a direction away from the wall 13' to provide greater space for a person to have unrestricted body movement while in the shower stall as best seen in FIG. 10.

The offset medial section 18' includes a pair of end sections 21' and 22' at outer ends thereof, The outer ends of the end sections extend in opposite directions away from one another and are positioned at opposite ends of the arcuately-shaped midsection 18'. The end sections 23' and 24' are adapted to be engaged with opposing walls 12' and 14'' of the shower structure 10' to support the shower curtain 16' in a new and improved way thus providing important advantages to the user of the shower enlarger or one-piece curtain rod.

As a preferred standard construction, the one-piece curtain rod 11' can be manufactured having a standard bathtub length of 4 feet 10¾ inches; however, deviation from the standard tub can dictate a shorter or longer length. End sections 21' and 22' can most desirably have a length of about 8 inches. The offset of the offset medial portion 18' can most desirably be of the order of 6 inches measured from the mid-point of the medial rod portion 18' to the mid-portion of the end sections 21' and 22'; however, for larger than normal-sized people this offset medial portion can be larger. The rod 11' is arcuately-shaped in the mid-section 18'. When the shower enlarger or curtain rod 11' is mounted in the shower structure 10', the rod is most desirably mounted even with the back face of the front of the tub so that the end sections 21' and 22' (as hereafter will be described in further detail) will line up with the back face of the front of the tub 15'. It will be further appreciated that in a normal shower rod installation of the type where the shower rod is just a continuous straight rod, the shower rod would be mounted in a position where it would be disposed vertically above and in line with the front face of the tub. By providing a new and improved shower enlarger or offset curtain rod as herein disclosed at 11', the shower curtain can be moved laterally away from the rear wall 13' to provide greater space in the shower stall for personal comfort.

It will be appreciated that when the shower enlarger 11' is to be mounted in the shower structure 10 that ring-shaped end sections or plates 23' and 24' are all adapted to be secured by suitable fasteners such as metal screws 40 (FIG. 8) to properly position and to permanently install the curtain rod in its desired aligned position above the back face of the front of the tub 15'. These plates 23' and 24' are preferably welded to the end sections 21' and 22' of the rod 11' where the components are of a metallic construction. If desired, the plates 23' and 24' can be adjustably secured and the rod 11' by set screws as shown in FIG. 7.

Figure 11:
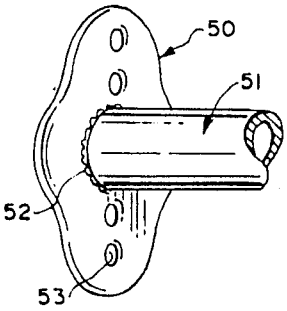
FIG. 11 is a fragmentary perspective view of a modified type of hanger bracket for the shower enlarger.
Figure 12:
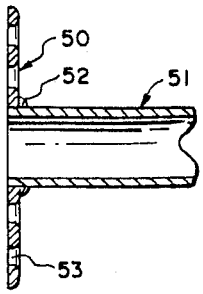
FIG. 12 is a fragmentary side view of the hanger bracket shown in FIG. 11.

In FIGS. 11 and 12, I have shown a modified hanger bracket construction 50 which is adapted for securement to a shower enlarger 51 of either of the types previously discussed. In this instance, the shower enlarger 51 is welded at 52 to the bracket 50. A series of holes are arranged in pairs above and below the shower enlarger 51 for attachment of the assembly to a wall as previously described.

Figure 13:
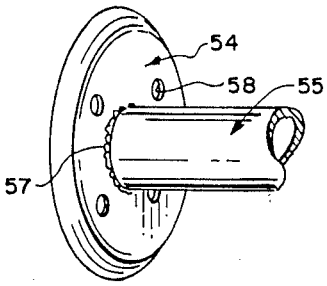
FIG. 13 is a fragmentary perspective view of still another modified hanger bracket.
Figure 14:
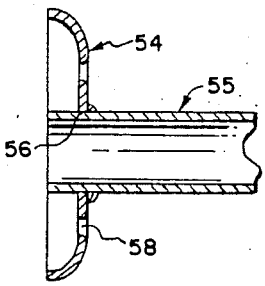
FIG. 14 is a fragmentary side view of the hanger bracket shown in FIG. 14.

In FIGS. 13 and 14 I have shown still another type of mounting bracket as indicated at 54. This bracket is adapted for assembly with a shower enlarger 55 or either of the types previously discussed. The mounting bracket 54 has a hole 56 in it and the end of the shower enlarger 55 is engaged within the hole 56. The bracket 54 is welded at 57 to the end of the shower enlarger 57. Since the mounting bracket 55 is of a heavier duty construction and has a greater thickness the shower enlarger can be securely mounted within the hole 56 and firmly supported in assembly therewith. The mounting bracket 54 also has screw holes 58 enabling screws to be projected through the mounting bracket to secure the assembly to a wall in adjacency to a tub or a shower.

Figure 15:
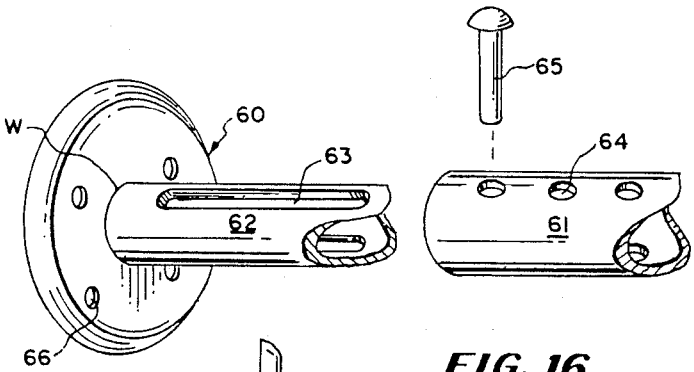
FIG. 15 is an exploded view of still another hanger bracket showing the way that one end of the shower enlarger can be mounted thereon.
Figure 16:
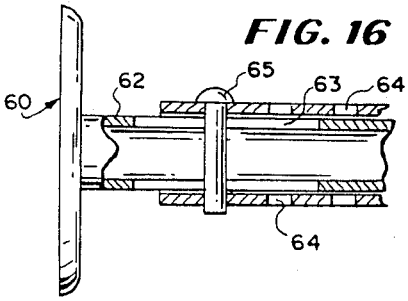
FIG. 16 is a fragmentary side assembly view of the hanger bracket with the shower enlarger shown in FIG. 15.

In FIGS. 15 and 16, I have shown still another mounting bracket assembly and the reference numeral 60 so identifies it. The bracket assembly is cooperable with an end of a shower enlarger 61 which may be of either type as shown in FIGS. 1-10. The bracket 60 has a supporting shaft 62 provided with an elongated slot 63. The shaft 62 is suitably secured such as by welds at W at one end to the mounting bracket 60 as is shown in FIG. 15. The end of the shower enlarger 61 has a series of axially spaced holes 64 which are alignable with the slot 63 when the shower enlarger 61 is telescoped over the shaft 61. A pin 65 is insertable through the hole 64 into the slot 63 and then projects outwardly to a second set of holes 64 (FIG. 16) in a bottom side of the end of the shower enlarger to anchor the shaft 62 in assembly with the shower enlarger 61. The attachment bracket 60 is also provided with mounting holes 66 enabling fasteners to be projected through the mounting bracket to secure the mounting bracket to a wall in a conventional manner. The pin 65 can be anchored by a nut with the pin being a bolt. The possibility also exists that if it is mounted perpendicular to the ground and the punch holes are on top, then there would be no need for any other mount of fastener.

Figure 17:
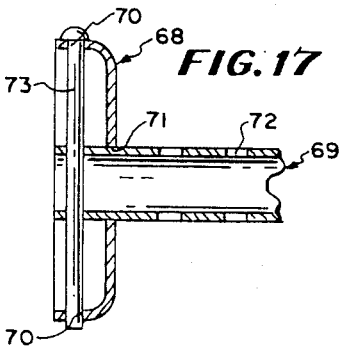
FIG. 17 is a fragmentary side view of still another type of hanger bracket with an end of the shower enlarger being secured in assembly therewith.

In FIG. 17, I have illustrated still another modified type of hollow metal mounting bracket 68. The bracket 68 is adapted to be used with a shower enlarger of either type as previously discussed, and which is indicated generally at 69. The mounting bracket 68 has a pair of drilled bracket passageways 70—70 and another passageway 71, which passageways 70 and 71 are disposed in right angular relationship to one another. The passageway 70 is adapted to receive an end of the shower enlarger 69. The end 69 of the shower enlarger also has a series of punched holes indicated at 72. A pin 73 is provided for the purpose of anchoring the end of the shower enlarger 69 to the mounting bracket 68. This pin 73 is engagable within the bracket passageways 70—70 in the mounting bracket 68, and also through one of the punched enlarger holes 72. It is in this way that the shower enlarger can be firmly anchored to the wall in accordance with additional features of my invention. A nut or a cotter pin (not shown) can be suitably secured to the pin 73 to fix it to the bracket 68 or to the pin 65 as required.

Figure 4:
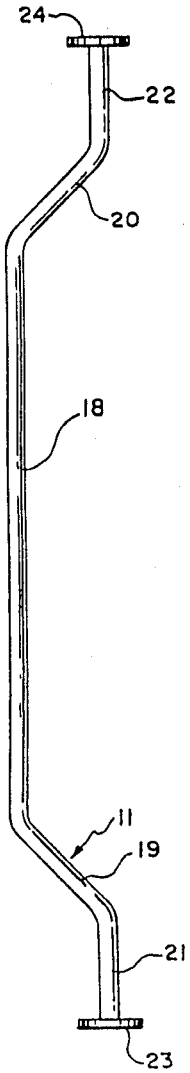
FIG. 4 is a top plan view of my shower enlarger.
Figure 18:
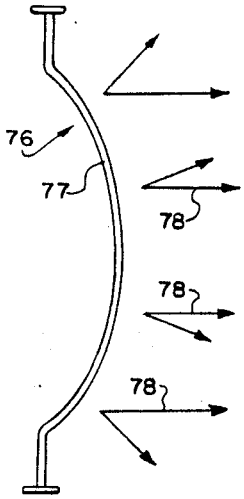
FIGS. 18 and 19 are top plan schematic views of one form of my shower enlarger with arrows diagrammatically showing the aerodynamic effect of air flow thereon.
Figure 19:
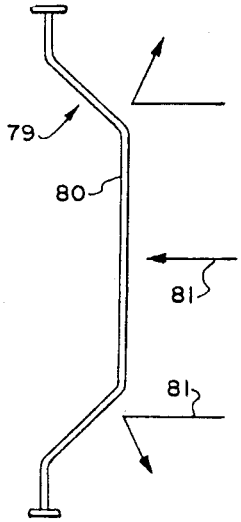

In FIGS. 18 and 19, I have shown my shower enlargers as earlier discussed and illustrated in FIGS. 10 and 4. In this instance, I have identified the shower enlarger in FIG. 18 by the reference numeral 76. This shower enlarger has an arcuate portion 77. The reference numeral 78 identifies arrows which illustrate the way in which air is circulated against the shower curtain and against the shower enlarger to maintain the shower curtain in engagement against the shower enlarger and out of contact with the body of the person using the tub or the shower.

In FIG. 19, I have shown the other shower enlarger also illustrated in FIG. 4. In this instance I have identified the shower enlarger with the reference numeral 79. This shower enlarger has an offset section 80 which has been previously described. Now when this shower enlarger 79 is mounted in a bathroom with an overhead fan in the same way as illustrated in FIG. 18, aerodynamic results occur whereby air is circulated and is caused to flow in the manner indicated by the arrows 81 whereby the shower curtain mounted on the shower enlarger 79 is held against the shower enlarger and out of contact with the body of the person using the tub or shower in accordance with important features of my invention.

With respect to the arrows on FIGS. 18 and 19, they are to show air flow; however, this air flow can be generated by overhead bathroom fans, air conditioning and air systems or also air currents caused by hot air rising because of the thermals from the shower's hot water.

DISCUSSION OF AERODYNAMICS, AIR CURRENTS AND STRUCTURAL RESISTANCE

The curved shower rod not only provides extra space, but also the curved surface of the shower curtain resists deflection or prevents "blow-in" both by mechanically caused air of exhausts, fans, etc. and naturally by the convection currents created when the shower is turned on. As the hot air inside the curtain rises and spills over the top of the rod, the ouside air tries to fill the void—often pushing a standard straight shower curtain against the body of the occupant. The curved curtain resists the deflection two ways: (1) Aerodynamically much of the air current is deflected to the sides reducing the total inward force and (2) the curved section actually increases the curtain's structural stiffness much the same way corrugations are used to strengthen structural members.

Figure 20:
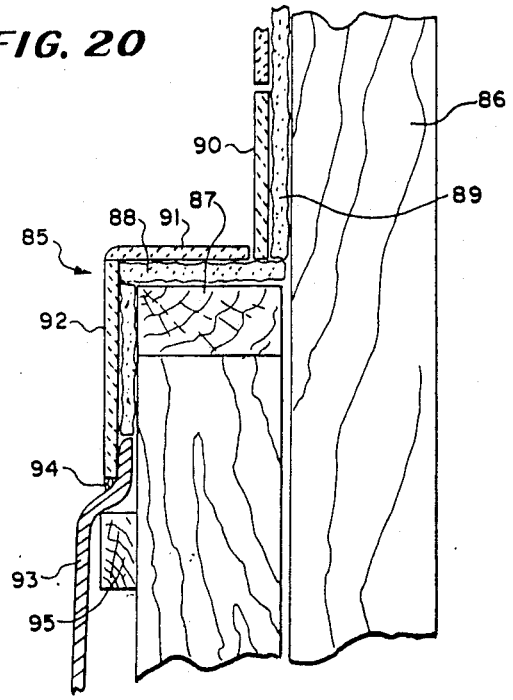
FIG. 20 is an enlarged fragmentary vertical section through a prior art tub and wall structure.

The reference numeral 85 shows a typical prior art construction for a shower or tub shelf. This type of a shelf construction can be used where it is desired to increase the tub area above the tub itself or to increase the shower area so that greater elbow room can be provided for a person using these types of bathing facilities. This prior art structure 85 includes a typical wall having vertical studs as indicated at 86. Mounted on the wall is a 2×4 type ledge 87. Mounted over the studs and the ledge are protective layers which may be of different constructions, as desired, one typical construction includes a cement board 88 which is mounted over the ledge 87. Another cement board 89 is mounted over the studs as indicated in FIG. 20. Mounted upon the cement boards 88 and 89 are ceramic tiles of different types as indicated at 90, 91 and 92. The tile 90 may be ceramic tile of a so-called thin set variety. The tiles 91 may be the so-called "bull nose" type of tile and the tile 92 may be of the same type as the tile 90. Indicated at 93 is a tub and it will be seen that this tub has an upper ledge that is located beneath the tile 92 and a sealant 94 is applied to prevent water from entering the wall at the joint between the tub and the tile. Also provided behind the tub 93 and mounted on the structure supporting the ledge 87 is a cleat 95. It will thus be appreciated that where the type of ledge construction illustrated at 85 in FIG. 20 is used, that the costs are quite substantial for producing a ledge so that a person using the bathing facility can have ample elbow room when either taking a shower or using the tub. The costs for this type of structural installation greatly exceed the cost of enlarging a shower or a bath facility where one of my different types of shower enlargers are used.

Figure 21:
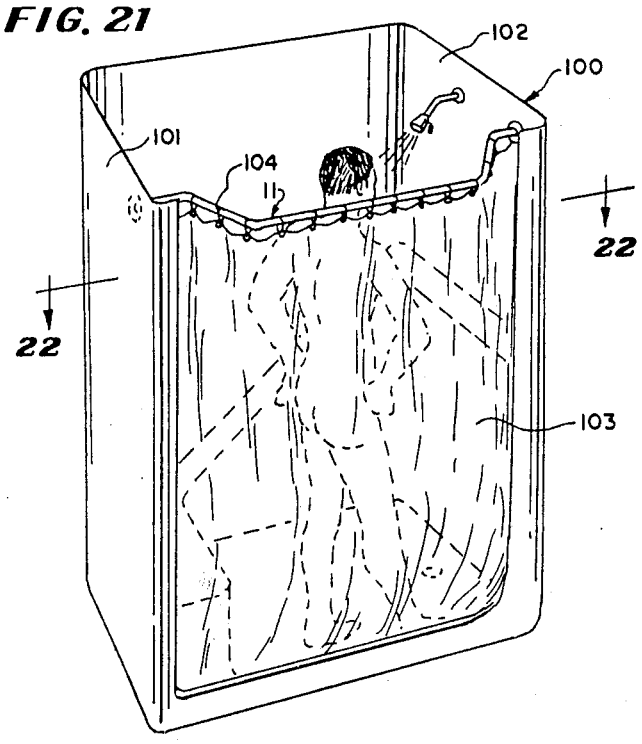
FIG. 21 is a prespective view of a shower stall with my shower enlarger mounted therein.
Figure 22:
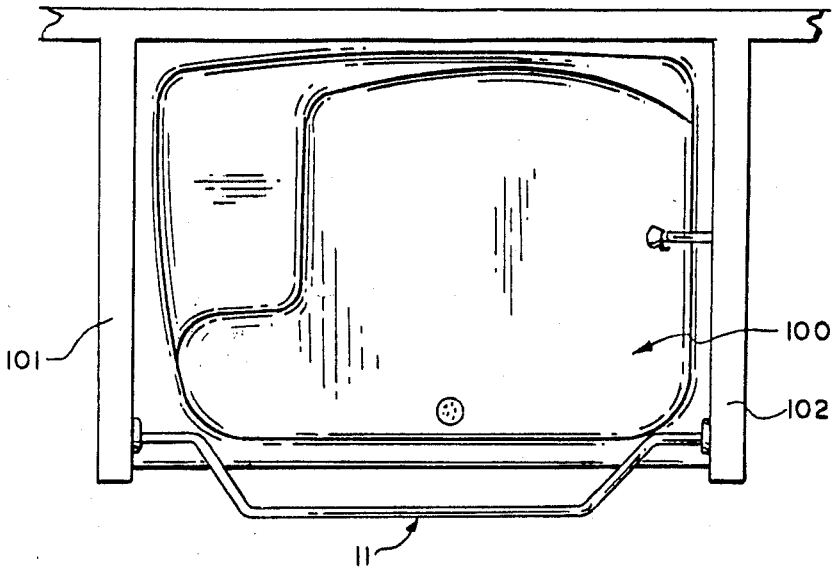
FIG. 22 is an enlarged fragmentary view of another type of a shower stall having my shower enlarger of the type shown in FIG. 19 mounted thereon.
Figure 23:
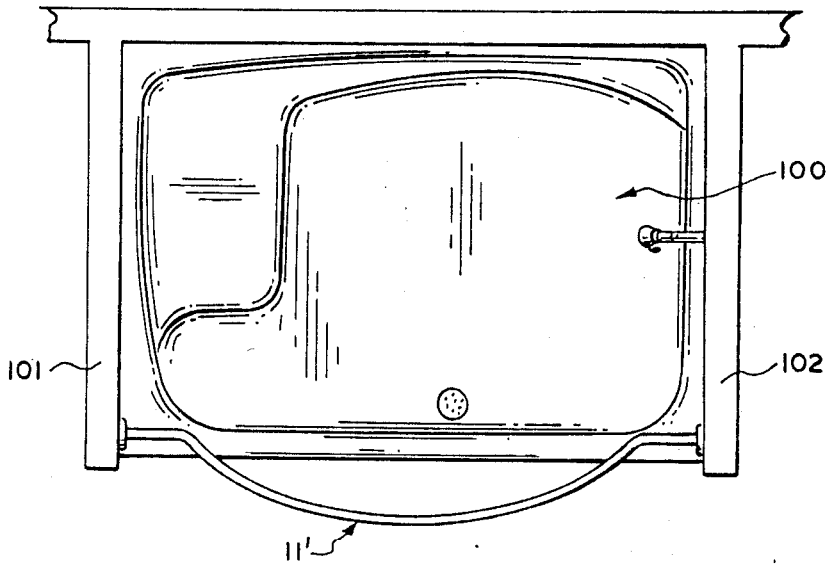
FIG. 23 is an enlarged fragementary view of the shower stall of FIG. 22 having a shower enlarger of the type shown in FIG. 18 mounted thereon.

Illustrated in FIG. 21 is another shower facility 100. This shower facility has a shower enlarger mounted to its side walls 101 and 102. The shower enlarger is of the type illustrated in FIG. 4 at 11. The shower enlarger 11 can be mounted to the side walls 101 and 102 of the shower stall 100 by any suitable arrangement as previously described herein. Also illustrated in the shower stall 100 is a man and it will be seen that his elbows are extended to show that he can turn around in the shower and have ample room without having his body strike a shower curtain 103 which is mounted on the shower enlarger 11 by curtain hanger clips 104. The same shower stall 100 is also illustrated in FIG. 22 with the shower enlarger 11. Also shown in FIG. 23 is the same shower stall 100 only with a different shower enlarger which is of the type shown in FIG. 10 at 11 prime. FIGS. 21, 22 and 23 all illustrate the same shower stall 100 but shown how the different types of my shower enlarger 11 and 11 prime can be used in the same shower stall with the important advantages of my invention. Thus, it will now be perceived how my shower enlargers 11 and 11 prime can be either used with a tub type bathing facility or with a shower stall type bathing facility.

In summary, the concept shown in FIGS. 22 and 23 show how the two shapes of the Shower Enlarger can be used. One shower enlarger as an arch shaped medial section and the other has a bowed shaped medial section both with the same 6" off-set. They can be mounted identically either for a tub or a shower. The only difference would be the distances from the ends of each side of the stall. With the tub shower walls, the ends are 6" from each end before the rod beings its bow or bend. With the stall shower walls it will need 4" to 5" from each end before the rod begins its bow or bend, varying upon the size of the stall.

In view of the foregoing, it will be appreciated that most showers and bathtubs utilize:

1. A straight power rod usually mounted so that the rod runs from wall to wall directly above the outside ledge of the tub, and
2. A shower curtain that, when hooked or attached to the shower rod, hangs straight down, perpendicular to the floor.

In a conventional construction, as described above, the body movement of the person taking a shower is restricted. With the use of my new and improved shower enlarger or curtain rod, it is now possible to expand the space by providing a shower rod with an offset section as previously described and illustrated. Preferably, the offset section is of an angular shape or construction to provide a maximum area of offset to allow a greater area for a person to move while showering without contacting the curtain.

LIST OF ADVANTAGES OF THE SHOWER ENLARGER

1. Don't be pressed against the wall of your tub shower trying to have enough room.
2. Don't hug the wall to keep the wet shower curtain from sticking to your body, especially if you have a fiberglass tub, that negates the use of shower curtain magnets.
3. Don't feel closed-in and don't have your personal space violated.
4. Don't spend a lot of money remodeling to put a ledge around your tub trying to get enough space to shower comfortably—purchase a Shower Enlarger Curtain Rod for your bathtub.
5. Get 30% more showering space in your bathtub without costly remodeling.
6. Get enough extra space in your bathtub shower to turn around comfortably without the shower curtain touching or sticking to your body.
7. Easy to install, low in cost.

HOW TO MEASURE A SHOWER ENLARGER ROD HAVING AN OFFSET GREATER THAN 6" PERSONALLY FITTED FOR YOUR BODY

1. Place both hands on your hips at belt level,
2. Standing erect and comfortable, face the showerhead and move away from the wall until your left elbow barely touches the wall.
3. With your right hand on your hip, your right elbow would be pushing your present shower curtain away from your body.
4. The distance from your right elbow to the perpendicular line of the inside edge of your tub is the width size of your Shower Enlarger Rod. (Use the next highest inch). If this distance is greater than our standard of six inches (6"), then so indicate to the nearest larger inch -7"-8"-9".
5. The length of your Shower Enlarger Rod would be the outside length of your tub from wall-to-wall.

It will further be appreciated that the position of the shower enlarger 11 should be adjusted so that it would accommodate the widest or largest family member in the tub and would be installed in accordance with the measured size of this person.

I claim:

1. In a shower structure for bathing having a shower area defined on three sides by upright walls and having an open side above a shower rim with a shower curtain mounted thereby to provide a covered point of entry for a person, the improvement of a shower enlarger mounted in the shower area, the enlarger comprising a one-piece curtain rod having an offset medial section engageable with an upper area of the shower curtain positioned outwardly of the shower rim beyond the shower area for providing a greater stall space for upper body movement while showering and for holding a shower curtain out of body contact by resisting aerodynamic forces applied to a shower curtain from outside of the shower area, the offset medial section includes a pair of angular curtain rod sections which extend in diverging relation away from opposite ends of the offset medial section, the angular curtain rod sections having end sections at outer ends thereof overlying the shower rim, the outer ends of the end sections extending in opposite directions away from one another, means for securing the outer ends of the end sections in vertical overlying alignment with the shower rim and in assembly with opposed upright walls of the shower area, and the end sections being positioned in parallel relation to the mid-section.

2. In a shower structure for bathing having a shower area defined on three sides by upright walls and having an open side above a shower rim with a shower curtain mounted thereby to provide a covered point of entry for a person, the improvement of a shower enlarger mounted in the shower area, the enlarger comprising a one-piece curtain rod having an offset medial section engageable with an upper area of the shower curtain positioned outwardly of the shower rim beyond the shower area for providing a greater stall space for upper body movement while showering and for holding a shower curtain out of body contact by resisting aerodynamic forces applied to a shower curtain from outside of the shower area, the offset medial section includes a pair of angular curtain rod sections which extend in diverging relation away from opposite ends of the offset medial section, the angular curtain rod sections having end sections at outer ends thereof overlying the shower rim, the outer ends of the end sections extending in opposite directions away from one another, means for securing the outer ends of the end sections in vertical overlying alignment with the shower rim and in assembly with opposed upright walls of the shower area, and said end sections being positioned with relation to said mid-section so as to extend generally in the same direction.

3. The shower structure of claim 2 further characterized by said means for securing the ends of the end sections in assembly including ring-shaped end plates secured in welded assembly with the outer ends of the end sections, and fasteners securing the ring-shaped end plates to opposed walls of the shower area.

4. The shower structure of claim 2 further characterized by said means for securing the ends of the end sections in assembly incuding ring-shaped end plates securable in assembly with the outer ends of the end sections, at least one of the end plates having a set screw extending through the ring-shaped end plate in telescoped engagement with the associated end section of the rod so that the position of the end plate can be varied with respect to the rod to enable the rod to be mounted in shower areas having upright walls which are spaced at different distances apart from one another.

5. In a shower structure for bathing having a shower area defined on three sides by upright walls and having an open side above a shower rim with a shower curtain mounted thereby to provide a covered point of entry for a person, the improvement of a shower enlarger mounted in the shower area, the enlarger comprising a one-piece curtain rod having an offset medial section engageable with an upper area of the shower curtain positioned outwardly of the shower rim beyond the shower area for providing a greater stall space for upper body movement while showering and for holding a shower curtain out of body contact by resisting aerodynamic forces applied to a shower curtain from outside of the shower area, the offset medial section includes a pair of angular curtain rod sections which extend in diverging relation away from opposite ends of the offset medial section, the angular curtain rod sections having end sections at outer ends thereof overlying the shower rim, the outer ends of the end sections extending in opposite directions away from one another, means for securing the outer ends of the end sections in vertical overlying alignment with the shower rim, and in assembly with opposed upright walls of the shower area, and said end sections being positioned with relation to said mid-section so as to extend generally in the same direction, the offset medial portion having a depth of 6" to 8" to a center line of the rod.

6. In a shower structure for bathing having a shower area defined on three sides by upright walls and having an open side with a shower curtain mounted therein to provide a covered point of entry for a person, the improvement of a shower enlarger mounted in the shower area, the enlarger comprising a one-piece curtain rod extending generally in lineal direction but having an arcuately offset medial section engageable with an upper area of the shower curtain for providing a greater stall space for upper body movement while showering, the one-piece curtain rod extending in an essentially lineal direction with the exception of the arcuately offset medial section which bulges to one side of the lineal direction of the rod for expanding the shower area the arcuately offset medial section having a radius of curvature, a shower curtain mounted and supported on the one-piece curtain rod, the arcuately medial section of the curtain rod co-acting with the shower curtain to arcuately bulge the shower curtain thereby providing a greater stall space for upper body movement, the arcuately offset medial section having end sections at outer ends thereof, the outer ends of the end sections extending in opposite directions away from one another, means for securing the outer ends of the end sections in assembly with opposed upright walls of the shower area, and said end sections being positioned in parallel relation to said mid-section.

7. A shower enlarger which comprises a one-piece curtain rod extending generally in a lineal direction but having an arcuately offset medial section for outwardly displacing an upper area of a shower curtain to allow a greater space in a shower structure for upper body movement while showering, the one-piece curtain rod extending in an essentially lineal direction with the exception of the offset medial section which bulges to one side of the lineal direction of the rod for expanding the shower area, the arcuately offset medial section having a radius of curvature, a shower curtain mounted and supported on the one-piece curtain rod, the offset medial section of the curtain rod co-acting with the shower curtain to arcuately outwardly bulge the shower curtain thereby providing a greater stall space for upper body movement and for holding a shower curtain out of body contact by resisting aerodynamic forces applied to a shower curtain from outside of the shower area, and for holding a shower curtain out of body contact by resisting aerodynamic forces applied to a shower curtain from outside of the shower area, the arcuately offset medial section having end sections at outer ends thereof, the outer ends of the end sections extending in opposite directions away from one another, said end sections being adapted to be engaged with opposed walls of a shower stall.

8. In a shower structure for bathing having a shower area defined on three sides by upright walls and having an open side with a shower curtain mounted therein to provide a covered point of entry for a person, the improvement of a shower enlarger mounted in the shower area, the enlarger comprising a one-piece curtain rod extending generally in a lineal direction but having an arcuately offset medial section engageable with an upper area of the shower curtain for providing a greater stall space for upper body movement while showering and for holding a shower curtain out of body contact by resisting aerodynamic forces applied to a shower curtain from outside of the shower area, the arcuately offset medial section having a depth of 6" to 8" to a center line of the rod, the one-piece curtain rod extending in an essentially lineal direction with the exception of the offset medial section which bulges to one side of the lineal direction of the rod for expanding the shower area, the arcuately offset medial section having a radius of curvature, a shower curtain mounted and supported on the one-piece curtain rod, the offset medial section of the curtain rod co-acting with the shower curtain to arcuately outwardly bulge the shower curtain thereby providing a greater stall space for upper body movement, the arcuately offset medial section having end sections at outer ends thereof, the outer ends of the end sections extending in opposite directions away from one another, means for securing the outer ends of the end sections in assembly with opposed upright walls of the shower area, and said end sections being positioned with relation to said mid-section so as to extend generally in the same direction.

9. The shower structure of claim 7 further characterized by the arcuately-shaped offset medial section having a depth of 6" measured from a plane through the end sections to a center line of the medial section.

10. The shower structure of claim 8 further characterized by detachable mounting means provided for mounting opposite ends of the shower enlarger on opposed walls of the shower structure.

11. The shower structure of claim 2 further characterized by detachable mounting means provided for mounting opposite ends of the shower enlarger on opposed walls of the shower structure.

* * * * *